US005127298A

United States Patent [19]

Snape et al.

[11] Patent Number: 5,127,298

[45] Date of Patent: Jul. 7, 1992

[54] GUITAR TREMOLO STABILIZER

[76] Inventors: Anthony P. Snape; Geoffrey T. Faulkner, both of 4 Keel Court, Noarlunga Downs, South Australia, Australia

[21] Appl. No.: 641,543

[22] Filed: Jan. 15, 1991

[51] Int. Cl.[5] ..... G10D 3/14

[52] U.S. Cl. ..... 84/313

[58] Field of Search ..... 84/298, 307, 312 R, 84/312 P, 313

[56] References Cited

U.S. PATENT DOCUMENTS 4,823,669 4/1989 Sarricola, Jr. ..... 84/313

4,928,564 5/1990 Borisoff et al. ..... 84/313

*Primary Examiner*—L. T. Hix

*Assistant Examiner*—Howard B. Blankenship

*Attorney, Agent, or Firm*—Darby & Darby

[57] ABSTRACT

A tremolo stabilizer device for fine tuning an electric guitar having a tremolo system which includes a bridge plate assembly having a plurality of counterbalancing springs housed in a cavity in the bottom face of the guitar, each of the springs being connected to a spring anchor secured to the guitar body in the cavity and to a depending tremolo lever arm which extends into the cavity, said stabilizer device comprising an elongate member which is adjustable in length and positionable interiorly of one of the counterbalance springs so as to extend therethrough, one end of the elongate member abutting against the lever arm and placing the spring under tension, arranged so that in the event of any accidental change in spring tension, the tremolo system will automatically return to its normal inactive position.

8 Claims, 4 Drawing Sheets

GUITAR TREMOLO STABILIZER

The present invention relates to apparatus for tuning musical instruments, and more particularly to a tremolo stabilizer for stabilizing a tremolo unit of an electric guitar or similar stringed instrument.

There are two different styles of playing a stringed instrument such as a guitar. In one style, the pitch of the strings is preferably altered by using a tremolo bar, which means that if a string is broken then the guitar is useless, as it will no longer be in tune. In the other style, the pitch of the strings can only be altered by physical pushing or pulling on the strings, but if a string breaks then the guitar will stay in tune. Accordingly, many guitar players find it necessary to have two guitars to play.

There have been many proposals to overcome the abovementioned problem, but all suffer from various disadvantages. For example, one prior art arrangement employs safety catches which requires secondary adjustments; however these cannot be made during playing, as both hands are needed to play the instrument. Other proposals require insertion of screws into the body of the guitar and increasing tension to give tougher and restricted movement to a tremolo guitar.

The Applicants are also aware of the tremolo control system disclosed in U.S. Pat. No. 4,928,564 (Borisoff et al) which overcomes the abovementioned problems by allowing the tremolo unit to be adjusted and then set in a semi-fixed stationary position, thus giving all the desirable features of a nontremolo guitar. The adjustment of the stabilizer allows the player to have all the advantages of a fixed bridge system. In Borisoff, this has been achieved by replacing one of the counterbalancing springs connected to the tremolo lever arm with a stabilizing device which incorporates a compression coil spring arranged so as to exert a pulling force on the tremolo lever arm. The stabilizer device also includes adjustment means and mechanical stop means which co-operate together to facilitate the fine tuning of the guitar and for the return to the pre-selected tune condition is made positive after the tremolo lever arm is released.

The installation of the Borisoff tremolo stabilizer device requires the use of additional screws which may, over a period of time, become dislodged due to the use of the tremolo. In addition, since there is usually a pick-up cavity directly above the screw positions, problems may arise during installation due to there being insufficient body thickness for receiving the screw thread. In addition, the stabilizing device contains numerous moving parts which are therefore subjected to wear during use. Still further, it is doubtful whether a compression spring of the kind shown in Borisoff will successfully operate with sufficient accuracy with instruments having very heavy gauge strings (in the order of 0.011–0.056 inches).

The present invention is directed to a novel tremolo stabilizer unit having similar characteristics to that of Borisoff but which is of even more simple construction and will overcome some of the disadvantages associated with the prior art.

It is the main object of the present invention to provide an improved tremolo stabilizer device for an electronic guitar which is of extremely simple design, easy to install and which co-operates with an existing counterbalancing spring of the known tremolo system employed in musical instruments.

Another object of the present invention is to provide an improved stabilizer device which can be very readily adjusted to retain the desired tuned condition of the guitar strings and which remains accurately set during operation.

Broadly according to this invention therefore, the tremolo stabilizer comprises an adjustable elongate member formed of essentially rigid material which can be metal, plastic or any other suitable material, positioned so as to extend axially through the interior of a counterbalance spring of an existing tremolo system, with one end of said member making pressure contact against the tremolo lever arm, so that when in use, in the event of any accidental change in spring tension, e.g. by means of a broken playing string, the tremolo unit will remain in its original pre-set position. The term "similar stringed instrument" as used herein, means any stringed instrument comprising a tremolo unit.

Preferably the elongate member comprises co-operable first and second parts, said first part having a male threaded portion which threadably engages a female threaded portion on said second part, there being locking means between said parts to inhibit relative axial movement thereof.

In another preferred embodiment of the invention, the stabilizer device comprises an adjustable compensator pin for releasably connecting said elongate member at its distal end with respect to the spring anchor support, said pin having a portion abutting against said spring support. In the event of a string breaking, the neck of the guitar will bow as a result of which the remaining strings will automatically stretch due to relief of pulling tension on the guitar neck. By pressing the compensator pin inwards, this will cause the elongate arm of the stabilizer device to move horizontally in the direction of the tremolo lever arm so as to exert a pushing force there against, to in turn relieve the tension on the remaining strings and in turn bringing them back to their original pitch. Generally, a compensator pin will normally be required only with heavy gauge strings and not with light to normal or medium gauge strings.

In order to more fully explain the present invention, an embodiment is described hereunder in some further detail with reference to the accompanying drawings in which.

BRIEF DETAILED DESCRIPTION OF THE PREFERRED EMBODIMENT

Figure 1:
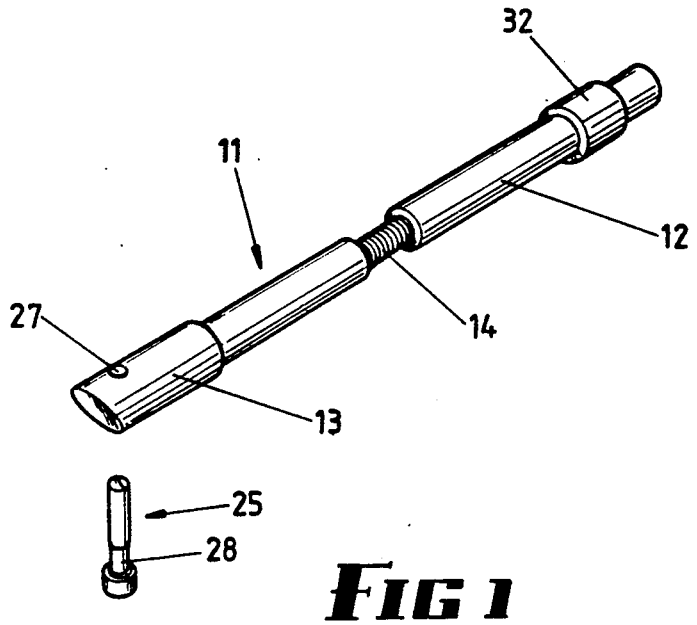
FIG. 1 is a perspective view of a tremolo stabilizer unit according to the present invention.

In this embodiment, a tremolo stabilizer device 10 consists of an essentially rigid length-adjustable elongate essentially cylindrical member 11 which can be made of plastics or metal. The member 11 comprises two threadably interconnected portions 12,13, portion 13 having a male thread 14 which threadably engages a female threaded portion 12' on portion 12.

Figure 6A:
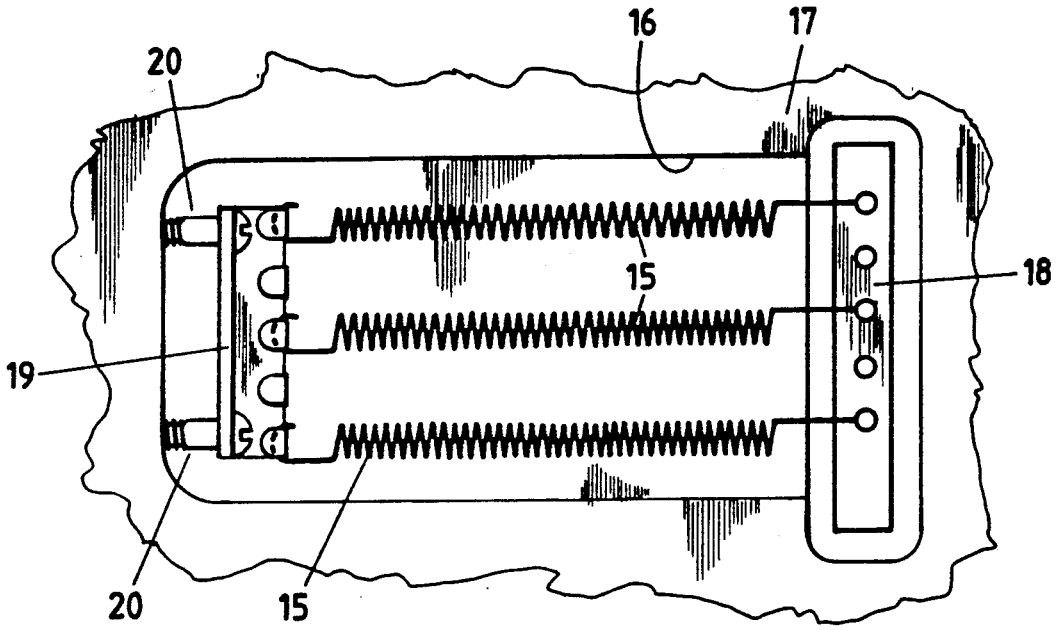
PRIOR ART FIG 6a
FIG. 6(*a*) is a fragmentary view of a prior art tremolo system showing a plurality of counterbalance tension springs, used with an electric guitar, whilst FIG. 6(*b*) is a similar view to 6(*a*), but showing the stabilizer of the present invention installed, with the tremolo arm actuated to increase the pitch of the strings.
Figure 6B:
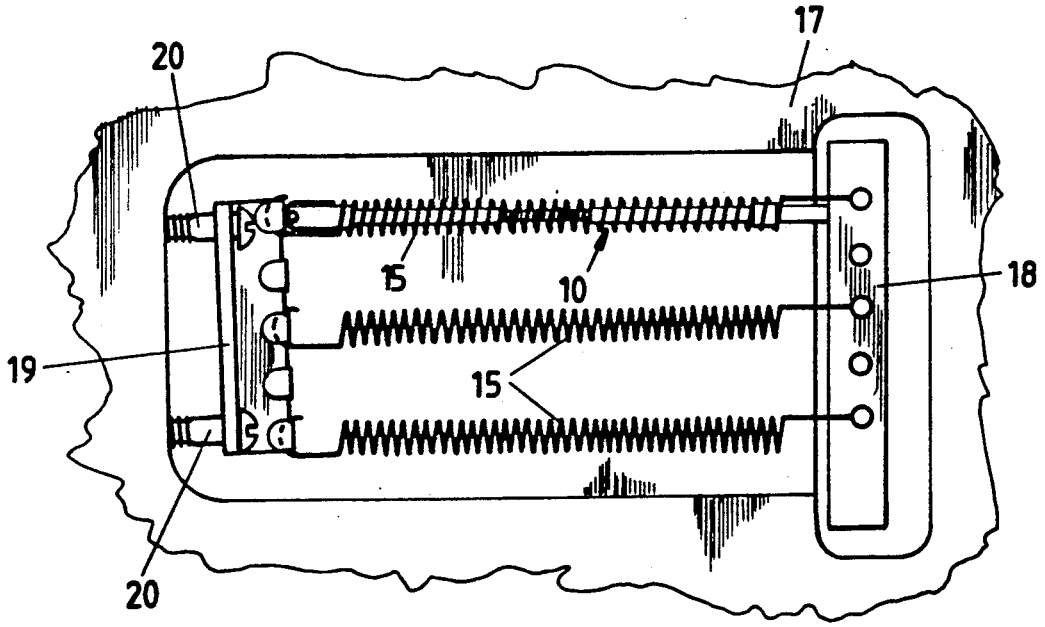

The stabilizer device 10 of this invention is designed to be embodied in a conventional tremolo system of an electric guitar which incorporates a counterbalance spring assembly of the type shown in FIG. 6(*a*). A plurality of counterbalance springs 15 are located within a cavity 16 provided in the bottom face of the guitar body 17, each spring 15 having one end connected by known means to the bottom of the depending tremolo lever arm 18, and its other end connected to an anchor 19 which is secured by screws 20 to the guitar body 17.

With this invention, the stabilizer member 11 is positioned interiorly of one of the counterbalance springs 15, preferably inside of the spring 15 which is aligned with the thickest string of the guitar, so as to extend axially therethrough. It should of course be appreciated that the stabilizer 10 can be inserted in any one of the tension springs 15. By screwing or unscrewing the portion 12 along the thread 14, the stabilizer is adjusted to a predetermined length to provide, in its fitted position, a small amount of tension across the tension spring 15 between the spring support 19, and the tremolo lever arm 18 which depends from the tremolo unit 21 which is pivotally supported on the guitar body 17 in accordance with known art.

In this embodiment, the portion 13 is formed by a threaded metal stud which has one end encased in plastic to form a solid head (refer FIG. 1), whilst portion 12 is formed of plastics tube, having threaded portion 12', extending along part of its length.

The member 11 accurately positions the depending tremolo lever arm 18 in a neutral stationary position and will not move unless the preset spring tension is overcome. This will not happen under normal playing conditions.

Figure 3:
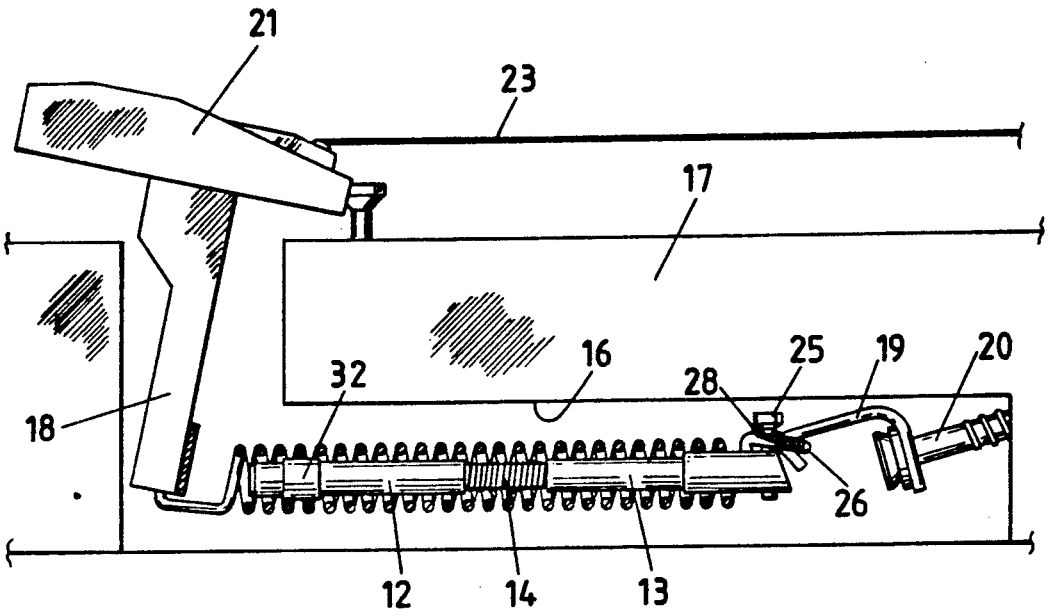
FIG. 3 is a part-sectional view of the stabilizer device of the present invention, installed in an electric guitar, showing the movement of the device when the tremolo lever arm is moved to decrease the pitch of the guitar strings.
Figure 4:
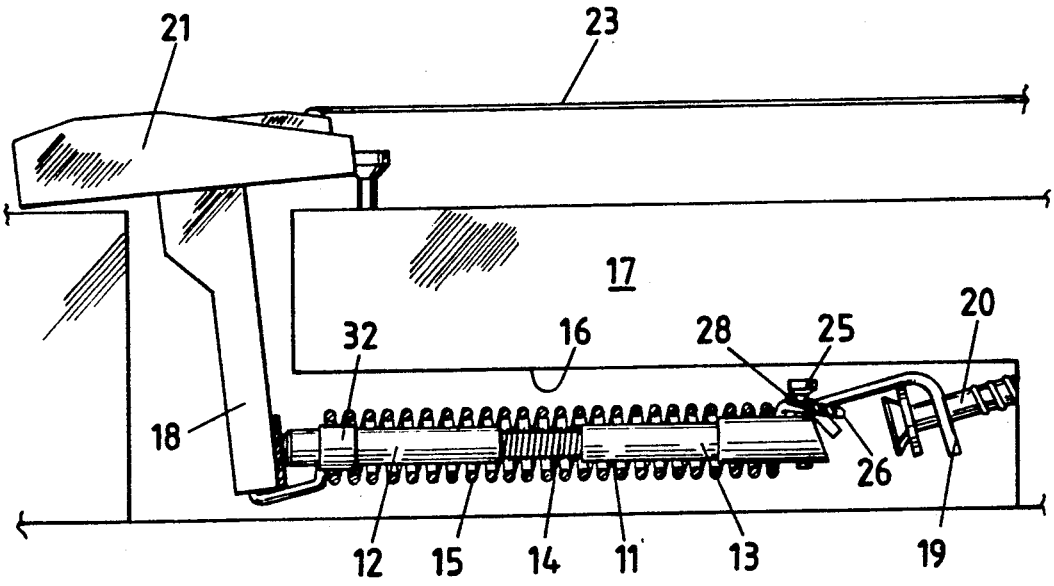
FIG. 4 is a view similar to FIG. 3 showing the position of the stabilizer device when the tremolo arm is actuated to increase the pitch of the strings.

With the stabilizer 11 fitted, the tremolo arm 22 can be moved to lower the pitch of the strings 23 since the tremolo lever arm 18 can move away from the portion 12 of the stabilizer 11 (refer FIG. 3). Conversely when the tremolo arm 22 is moved to raise the pitch of the strings 23 (refer FIG. 4), the member 11 pushes the spring anchor 19 back, thus allowing the pitch to increase. When the pitch of the string is raised using the tremolo arm 22, the stabilizer 11 transfers the force of the tremolo unit or bridge 21 to the spring anchor 19, causing it to move back, pivoting on its screw 20.

A pin 25 is used to connect the distal end of the member 11 to the spring anchor 19. The pin 25 is inserted through the eye formed by end loop 26 of the spring 15 and in turn passes through a diametral passageway 27 formed adjacent to the distal end of portion 13 of the member 11. An 0-ring 28 is fitted to prevent accidental removal or dislodgement of the pin 25 and also to reduce noise. The 0-ring 28 passes around the stem of the pin 25 and hooks onto the hooked end of the spring anchor 19, against which the stem abuts. A washer 30 preferably made of nylon, is fitted to screw 20 to also minimise noise.

Figure 2:
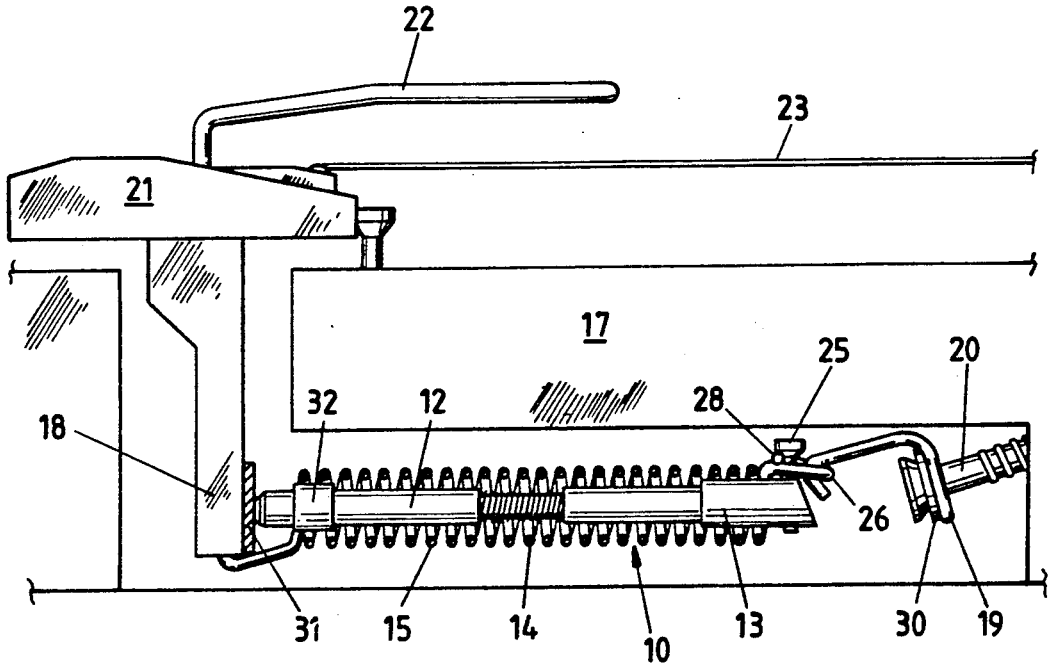
FIG. 2 is sectional view showing the tremolo stabilizer of this invention installed within an electric guitar in its normal inactive position.

As shown in FIG. 2 the proximal end of the member 11 bears against the depending tremolo lever arm 18. Preferably the member 11 makes contact with a disc 31 secured to the lower end of the arm 18. The disc 31 which is preferably 7×1 mm in size, is made of felt or silicone and gives a softer feel whilst not subtracting from performance or acoustical properties.

A further noise reduction measure is the provision of an enlarged diameter portion 32, integrally formed on portion 12 of the member 11. Enlarged portion 32 centralises the rod 11 in the spring 15 and minimises the extent of surface area contact between the rod and the convolutions of the spring 15. In this manner, the member 11 will always be centrally located within the spring 15.

Prior to fitting the stabilizer 10, the guitar must be in tune, with the tremolo unit 21 in its normal operating position. The spring anchor or holder 19 should be truly square (refer FIG. 6(*a*)). The stabilizer is now ready to be installed. Firstly the member 11 is placed against the appropriate spring anchor or holder 19 on a vacant hook and is laid across to the depending tremolo lever arm 18. The rod is then adjusted in length and an additional 1 mm is added. The spring anchor or holder 19, either has the mounting hole of the anchoring screw 20 drilled to a larger diameter (e.g. 6.3 mm), or the screw 20 is replaced by a smaller diameter screw. The spring support is replaced with the washer 30 placed between the anchor and head of the screw. The length of the member 11 is adjusted, by screwing portion 12 along the thread 14, so that the depending lever arm 18 is in its inactive tuned position. All springs 15 are replaced, ensuring that the member 11 is fitted inside one of the springs 15, in line with the E6 string 23, last. The E6 string 23 is retuned, by means of the adjustment screw 20 only. Finally, the other strings are retuned by normal procedure.

The present tremolo stabilizer has many advantages over prior art arrangements. The guitar, with the tremolo stabilizer inserted, is easier to tune, and stays in tune when dampening on the bridge. The guitar plays like a fixed bridge system, whilst having the advantages of a floating system. It is easier to replace strings and the guitar stays in tune even if a string is broken. Flutter is prevented or minimised and sustain, attack and response are increased. Tuning can be changed without retuning all other strings, and the guitar stays in tune when doing double-stops. The tremolo stabilizer is easily installed, with no drilling or routing required.

While the invention has been described in terms of the above preferred embodiment, in order to facilitate better understanding of the invention, it should be appreciated that various modifications can be made without departing from the principle of the invention. Therefore, the invention should be understood to include all such modifications within its scope.

Figure 5:
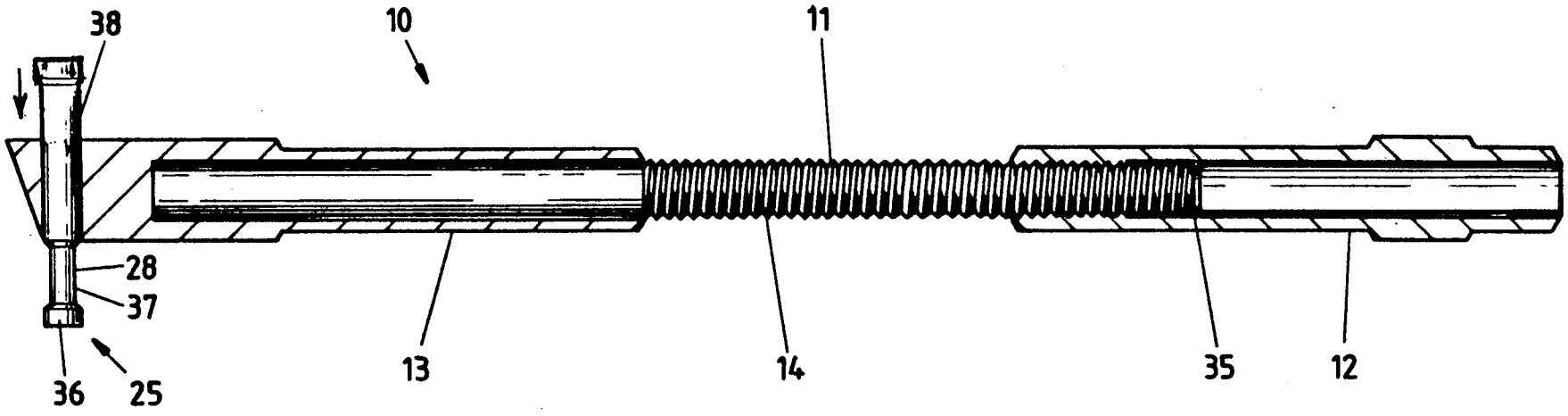
FIG. 5 is a sectional view of the stabilizer device of this invention.

In the embodiment shown in FIG. 5 of the accompanying drawings, an internal look sleeve 35 of plastics material is formed, e.g. by molding, in portion 13 of the member 11, whereby the threaded portion 14 of portion 13 will bite into the untapped sleeve 35 and be locked in position so as to avoid any inadvertent or accidental alteration of the setting of the tremolo stabilizer, e.g. due to the effect of vibrations, whilst the guitar is being played.

As also shown in FIG. 5 of the drawings, the pin 25 can be of the push-button type, having an enlarged head portion 36 which merges with a reduced diameter neck portion 37 which in turn merges with a larger diameter shank portion 38. When in its initial preset position, the pin 25 has its neck portion 37 exposed and against which the spring anchor 19 engages. If a string is broken, by pushing the pin 25 inwardly, the shank portion 38 is exposed and the anchor 19 is displaced, this in turn displacing the stabilizer rod 11 is displaced horizontally in the direction towards the tremolo lever arm 18 against which it is abutting. As a result the arm 18 is also moved rearwardly thus relieving tension on the remaining strings and thereby returning them to their previously fine tuned condition.

We claim:

1. A tremolo stabilizer for a guitar or similar stringed instrument having a pivotal tremolo unit which includes a depending tremolo lever arm, and a plurality of coiled counterbalancing tension springs each operatively coupled to and extending between said lever arm and a spring anchor, said stabilizer comprising an essentially rigid elongate member which is adjustable in length and positionable between said lever arm and said spring anchor to lie interiorly of and coaxial with one of said counterbalancing tension springs, one end of said member, when so positioned, making pressure contact with said lever arm, such that in the event of a change of spring tension occurring during playing of the guitar, the tremolo unit is automatically returned to its preset original position and the guitar strings to their original selected pitch.

2. A tremolo stabilizer for a guitar according to claim 1, wherein said member comprises co-operable first and second parts, said first part having a male threaded portion which threadably engages a female threaded portion on said second part.

3. A tremolo stabilizer for a guitar according to claim 2, further comprising locking means for locking said first and second parts against axial movement.

4. A tremolo stabilizer for a guitar according to claim 2, further comprising an enlarged portion on one of said parts adapted to centralise the member within said spring and minimise contact between said member and said tension spring during playing of the guitar.

5. A tremolo stabilizer for a guitar according to claim 2 wherein each said part comprises an hollow rod of metal or plastics material.

6. A tremolo stabilizer for a guitar according to claim 1, wherein said other end of said elongate member is releasably held in position by a removable pin insertable in a hole in said member and arranged to abut against said spring anchor.

7. In an electric guitar having a pivoted bridge assembly which includes a depending tremolo lever arm and a plurality of tremolo counterbalance springs connected with said pivoted bridge assembly, the improvement comprising a tremolo stabilizer comprising an essentially rigid elongate rod or tube positioned interiorly of one of said springs and extending axially therethrough, said rod or tube comprising co-operable first and second portions in threaded engagement with one another so as to provide axially adjustment thereof, one end of said rod or tube, when so positioned, making pressure contact with said tremolo lever arm, its other end being fixedly supported with respect to the spring anchor, arranged so that in the event of a change of spring tension occurring during playing of the guitar, the bridge assembly will automatically return to a selected neutral position.

8. A tremolo stabilizer for a guitar according to claim 7, wherein each said tube portion comprises an hollow rod of metal or plastics material.

* * * * *